US006606811B1

(12) United States Patent
Olson

(10) Patent No.: US 6,606,811 B1
(45) Date of Patent: Aug. 19, 2003

(54) FIREARM MAGAZINE WITH IMPROVED BOLT CATCH ACTUATOR

(75) Inventor: Douglas D. Olson, Vero Beach, FL (US)

(73) Assignee: Knight Armament Company, Vero Beach, FL (US)

( * ) Notice: Subject to any disclaimer, the term of this patent is extended or adjusted under 35 U.S.C. 154(b) by 0 days.

(21) Appl. No.: 10/267,218

(22) Filed: Oct. 9, 2002

(51) Int. Cl.[7] ..... F41A 9/61
(52) U.S. Cl. ..... 42/50
(58) Field of Search ..... 42/50, 88, 7, 6, 42/17, 18, 21, 22; 89/33.1

(56) References Cited

U.S. PATENT DOCUMENTS 295,563 A * 3/1884 Lee et al. ..... 42/50
2,870,561 A * 1/1959 Colby ..... 42/18
3,005,279 A * 10/1961 Brewer ..... 42/18
3,732,643 A * 5/1973 Wells ..... 42/50
4,502,237 A * 3/1985 Krogh ..... 42/50
4,888,900 A * 12/1989 Howard ..... 42/50
5,353,537 A * 10/1994 Mercenier ..... 42/7
5,473,834 A * 12/1995 Bammate ..... 42/7
5,588,241 A * 12/1996 Hurley ..... 42/50
5,638,626 A * 6/1997 Westrom ..... 42/50

* cited by examiner

*Primary Examiner*—Michael J. Carone
*Assistant Examiner*—D Buckley
(74) *Attorney, Agent, or Firm*—Carroll F. Palmer

(57) ABSTRACT

Detachable ammunition magazines for firearms, particularly conversions of M16/M4 series rifles to utilize AK47 magazines, are provided with improved bolt catch actuators. These new bolt catch actuators have an elliptical opening though the upper end of the proximal wall that extends into the rectangular cross-section passage within the firearm magazine. A wire spring defined by an upper free-end and a lower fixed-end is cantilevered by its fixed-end to the right side plate of the magazine follower for movement with the follower in a manner that enables the free-end of such wire spring to project through the opening when the follower reaches its apogee. As the wire's free-end passes through the opening it engages the bolt catch of the firearm causing the bolt to be retained in its open position after all the ammunition in the magazine has been fired.

2 Claims, 5 Drawing Sheets

FIREARM MAGAZINE WITH IMPROVED BOLT CATCH ACTUATOR

BACKGROUND OF THE INVENTION

1. Field of the Invention

This application relates broadly to detachable ammunition magazines for firearms. More particularly, it concerns an improved bolt catch actuator for such magazines that cause the firearm bolt to be retained in its open position after all the ammunition in the magazine has been fired. The new invention has particular reference to conversions of M16/M4 series of rifles to utilize magazines that did not originally provide a bolt catch actuator.

2. Description of the Prior Art

It is known to provide detachable firearm magazines with devices that cause the firearm bolt to be retained in its open position after all the ammunition in the magazine has been fired. These devices have been identified by various names. For example, U.S. Pat. No. 5,638,626 refers to them as a "bolt catch actuator", while U.S. Pat. No. 5,588,241 calls them a "bolt stop assembly" and U.S. Pat. No. 5,761,841 calls them a "bolt catch arm". In this specification, the term "bolt catch actuator" is used to identify this class of component for magazines that are detachable from the firearm to which they supply ammunition.

It should be noted that in the art of firearms the term "bolt catch" is used to identify a component of a firearm that moves between a latch position to hold the firearm bolt in an open position and a release position that allows the bolt to move-into its firing position. Less frequently, the term "bolt stop" is used in place of "bolt catch". Typically, the bolt catch is moved into the open retention position by a "ledge" which is also a part of the firearm as opposed to a detachable magazine. Thus, the term "bolt catch" refers to a part of the firearm per se in contrast to "bolt catch actuator" which refers to a part of a detachable firearm magazine.

Further examples of bolt catch actuators are disclosed in U.S. Pat. Nos. 4,069,608 and 4,888,900. Regardless of their specific construction, they serve to permit inspection of the cartridge chamber and notify the shooter that the magazine is empty.

OBJECTS

A principle object of the invention is the provision of detachable ammunition magazines for firearms comprising improved bolt catch actuators.

Another object is the provision of such improved bolt catch actuators that are self-retracting as the shooter loads ammunition into the magazine.

Yet another object is the provision of such improved bolt catch actuators that may be used to make inexpensive alteration of magazines that do not possess bolt catch actuators.

A further object is the provision of new or modified AK47 detachable ammunition magazines that interface with variations of M16/M4 series rifles that provide a bolt catch.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The invention provides improvements in detachable firearm ammunition magazines, particularly those from the AK47 series rifles that are adapted to work in modified forms of M16/M4 series rifles.

Such magazines essentially comprise an elongated housing having (1) a proximal wall defined in part by an upper end, (2) a distal wall parallel to the proximal wall, (3) a pair of opposing parallel sidewalls wider than the proximal and distal walls, (4) a closed bottom end and (5) an open top end together defining a rectangular cross-section passage sized to hold ammunition inserted through the open top end into the passage.

These magazines further comprise a U-shaped follower moveably carried in the housing with a spring defined by an upper portion and a lower portion positioned between the follower and the closed bottom end urging the follower toward the open top.

The follower is defined by a configured rectangular upper surface facing the open top end and a pair of opposed left side and right side plates depending from the upper surface providing a receiving space between the side plates into which the upper portion of the spring projects.

The improvement for such magazines provided by the invention is a new form of bolt catch actuators that are self-retracting as the shooter loads ammunition into the magazine and that do not require expensive alteration of the firearm with which the magazines are used.

These improved bolt catch actuators are characterized by an opening though the upper end of the proximal wall that extends into the rectangular cross-section passage of the firearm ammunition magazine and a wire spring defined by an upper free-end and a lower fixed-end, the wire spring being fastened by the fixed-end to the right side plate of the follower for movement with the follower within the rectangular cross-section passage in a manner that enables the free-end of the wire spring to project through the opening when the follower reaches its apogee. In turn, the free-end of the wire spring engages the bolt catch of the firearm to cause the firearm bolt to be retained in its open position after all the ammunition in the magazine has been fired.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
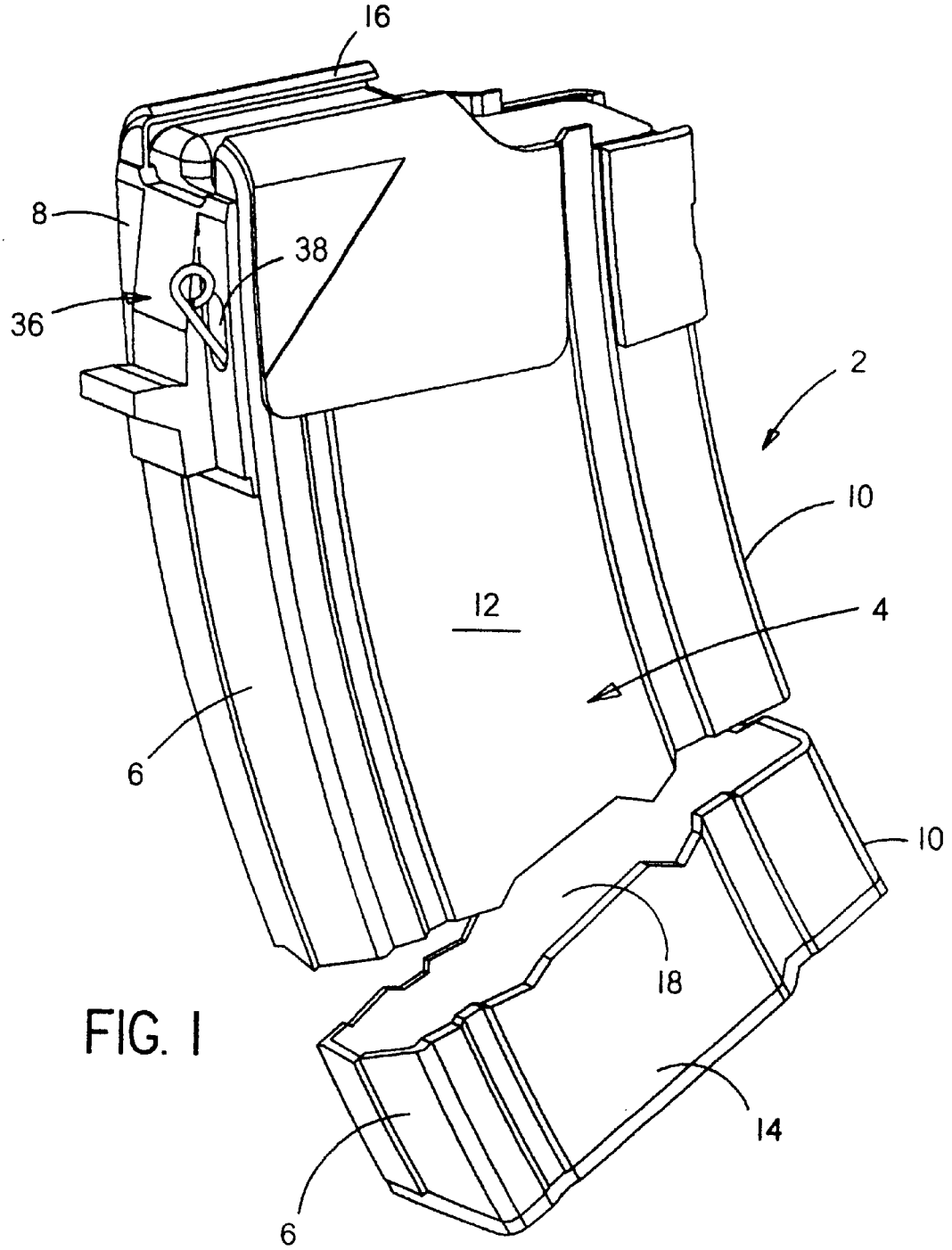
FIG. 1 is a fragmented isometric view of an ammunition magazine comprising the improved bolt catch actuator of the invention.

Referring to the drawings beginning with FIG. 1, a detachable firearm ammunition magazine 2 of the invention used with M16/M4 series of rifles modified to accept AK47 detachable ammunition magazines comprises an elongated housing 4 having a proximal wall 6 defined in part by an upper end 8, a distal wall 10 parallel to the proximal wall 6, a pair of opposing parallel sidewalls 12, a closed bottom end 14 and an open top end 16 together defining a rectangular cross-section passage 18 sized to hold ammunition for the firearm.

Figure 2:
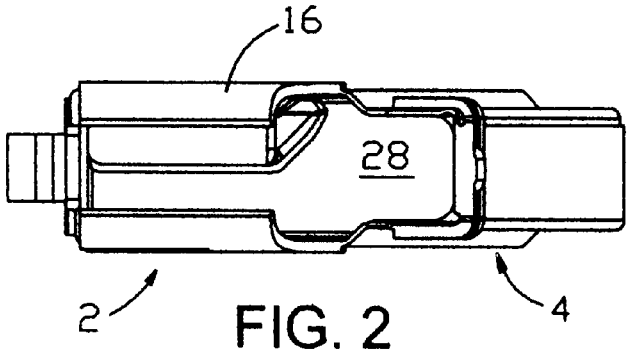
FIG. 2 is a plan view of the top of the ammunition magazine of FIG. 1.
Figure 3:
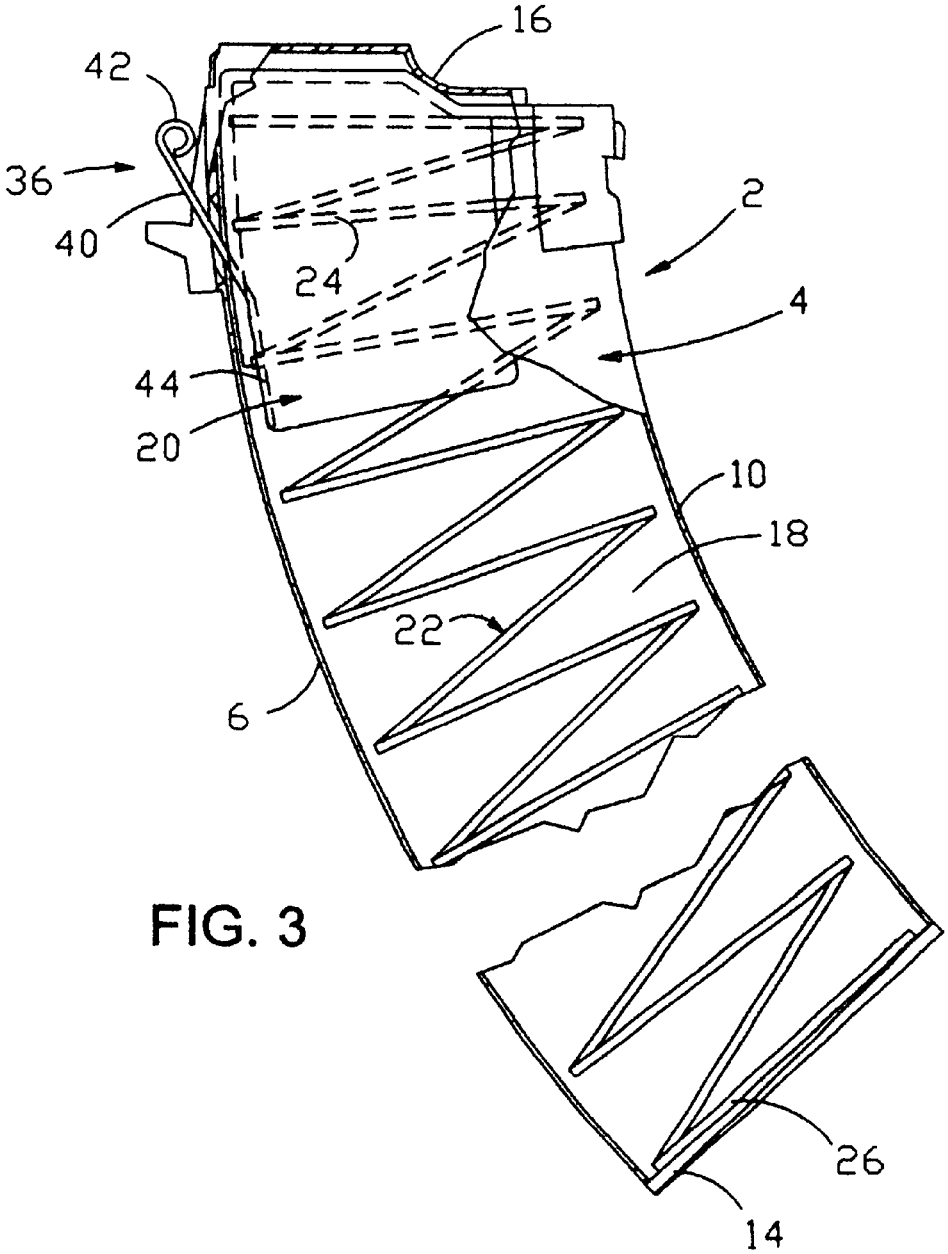
FIG. 3 is a fragmented lateral view of the ammunition magazine of FIG. 1 in smaller scale.

Referring to FIGS. 2 & 3, the magazine 2 further comprises a U-shaped follower 20 moveably carried in the housing 4 with a spring 22 defined by an upper portion 24 and a lower portion 26 positioned between the follower 20 and the closed bottom end 14 urging the follower toward the open top end 16.

Figure 5:
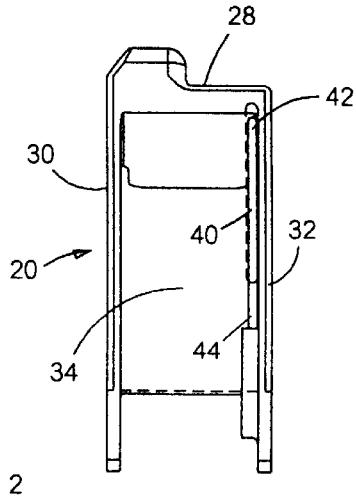
FIG. 5 is an elevated view of the proximal end of the follower in the magazine of FIG. 1.

Referring to FIGS. 3 & 5, the follower 20 is defined by a configured rectangular upper surface 28 facing the open top end 16 and the pair of opposed left side plate 30 and right side plate 32 depending from the upper surface 28 providing a receiving space 34 between the side plates 30 & 32 into which the upper portion 24 of the spring 22 projects.

Figure 4:
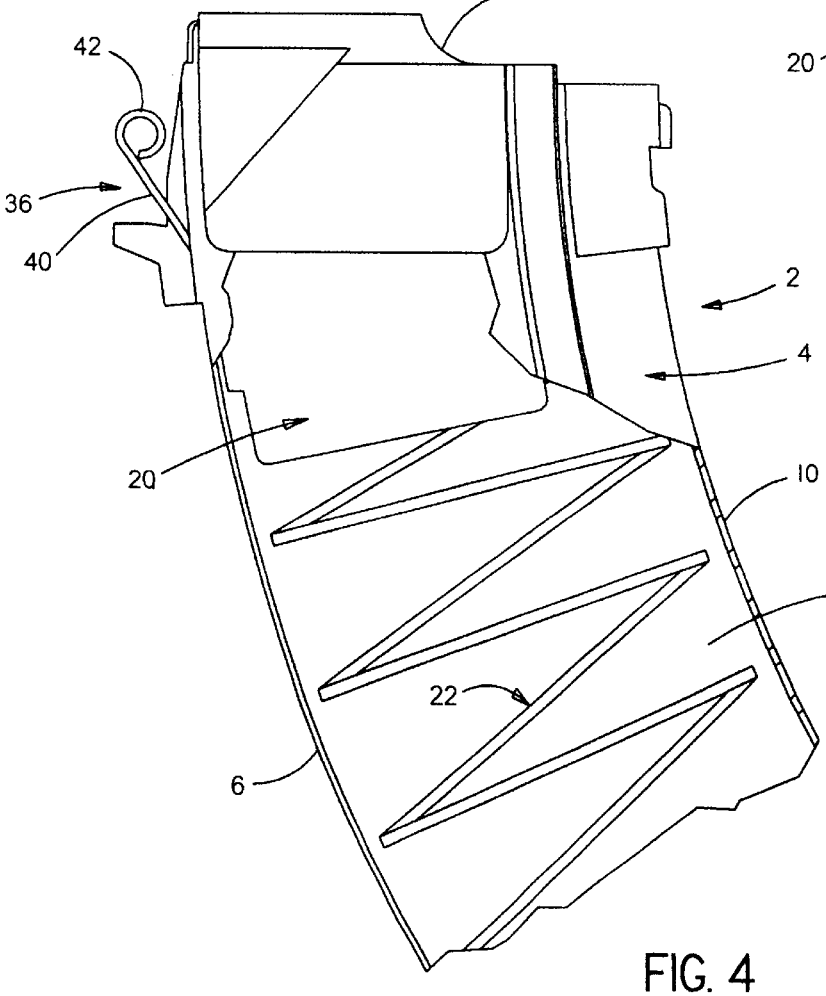
FIG. 4 is a lateral view similar to FIG. 3 but in larger scale.

Referring to FIGS. 1, 3–5 & 7, the improved bolt catch actuator 36 of the invention is characterized by an opening 38 though the upper end 8 of the proximal wall 6 that extends into the rectangular cross-section passage 18 of the firearm ammunition magazine 2 and a wire spring 40 defined by an upper free-end 42 and a lower fixed-end 44. The wire spring 40 is fastened by the fixed-end 44 to the right side plate 32 of the follower 20 for movement with the follower within the rectangular cross-section passage 18 in a manner that enables the free-end 42 of the wire spring 40 to project through the opening 38 when the follower 20 reaches its apogee as shown in FIGS. 3 & 4.

Figure 6:
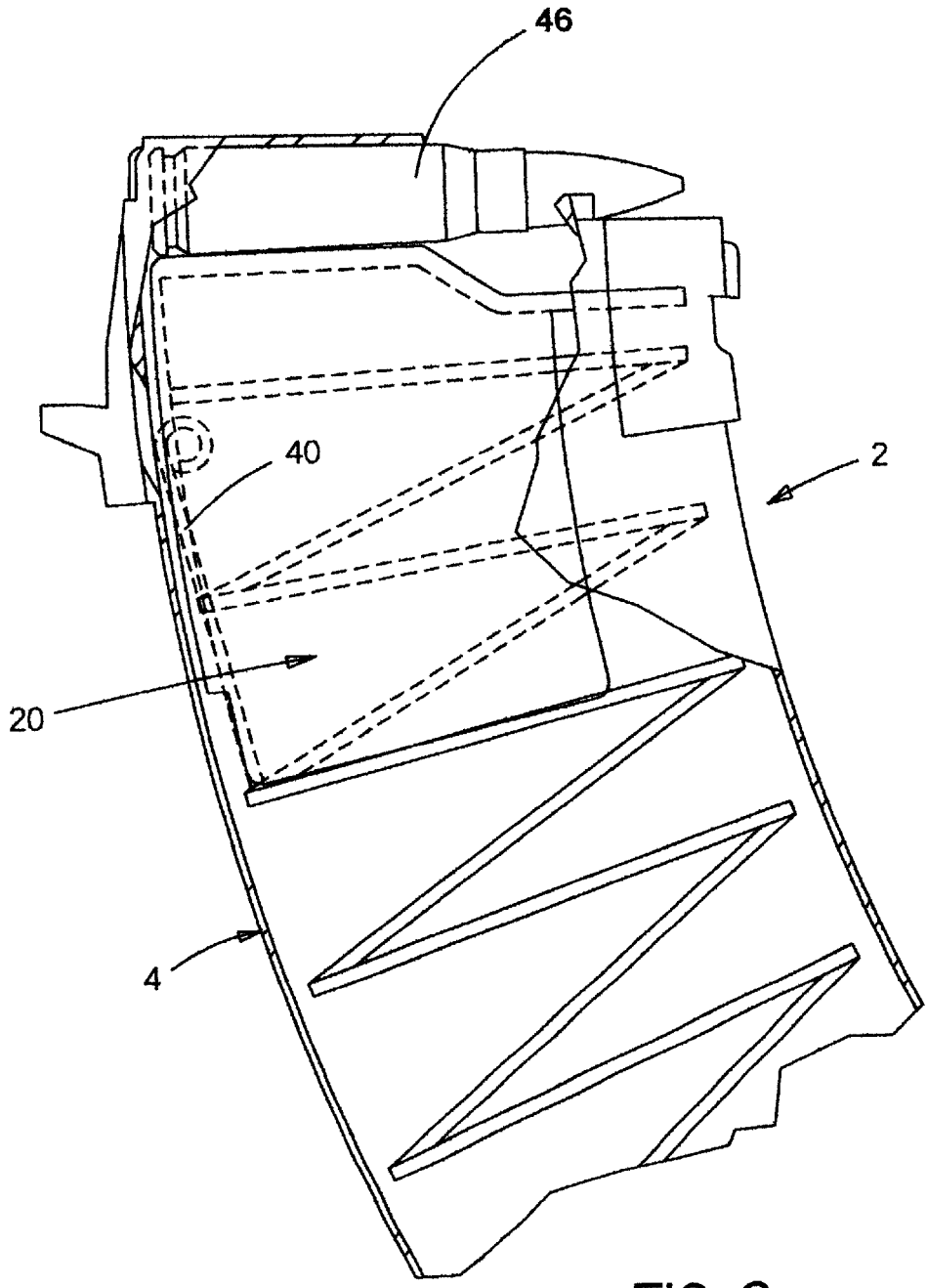
FIG. 6 is a lateral similar to FIG. 4, but with one cartridge in the magazine so that the follower has not reached its apogee.

FIG. 6 shows the magazine 2 containing a cartridge 46 holding the follower 20 below its apogee so the wire spring 40 is retracted through the opening 38 into the rectangular passage 18 of the housing 4.

Figure 7:
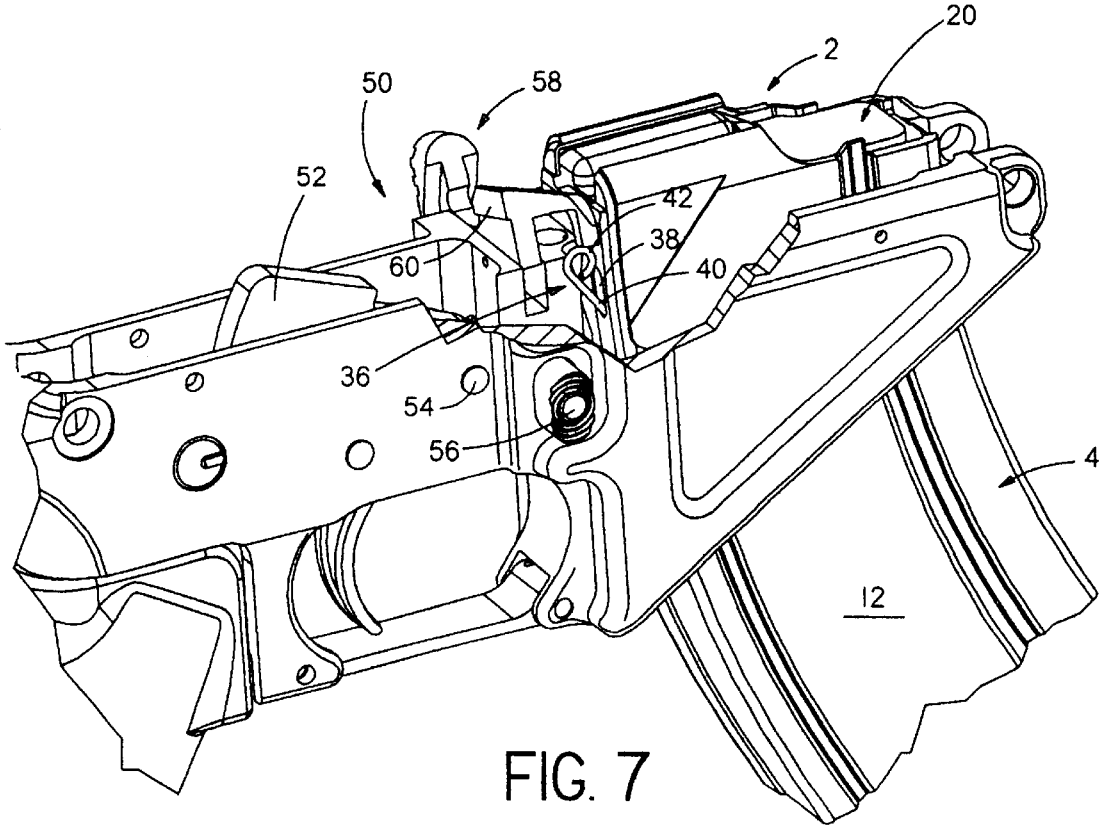
FIG. 7 is an isometric view of the lower receiver assembly of a firearm equipped with an improved ammunition magazine of the invention comprising a improved bolt catch actuator that causes the firearm bolt to be retained in its open position after all the ammunition in the magazine has been fired.

FIG. 7 shows the lower receiver assembly 50 of a modified M16/M4 series rifle including the hammer 52, hammer pivot pin 54, magazine release button 56 and bolt catch 58 with its bolt engagement face 60. The assembly 50 is fitted with magazine 2 of the invention in which the follower 20 has reached apogee so the upper free end 42 of the wire spring 40 has engaged and lifted the bolt catch 58 whereby the bolt (not shown) is retained in its open position after all the ammunition (not shown) in the magazine has been fired.

What is claimed is:

1. In a detachable firearm ammunition magazine comprising:

an elongated housing having (1) a proximal wall defined in part by an upper end, (2) a distal wall parallel to said proximal wall, (3) a pair of opposing parallel sidewalls wider than said proximal and distal walls, (4) a closed bottom end and (5) an open top end together defining a rectangular cross-section passage sized to hold ammunition inserted through said open top end into said passage and a U-shaped follower moveably carried in said housing with a spring defined by an upper portion and a lower portion positioned between said follower and said closed bottom end urging said follower toward said open top, said follower being defined by a configured rectangular upper surface facing said open top end and a pair of opposed left side and right side plates depending from said upper surface providing a receiving space between said side plates into which said upper portion of said spring projects, an improved bolt catch actuator characterized by:

an elliptical opening through said upper end of said proximal wall extending into said rectangular cross-section passage of said firearm ammunition magazine and a wire spring defined by an upper free-end and a lower fixed-end, said wire spring being cantilevered by said lower fixed-end to said right side plate of said follower with said upper free-end positioned below and biased proximally of said rectangular upper surface whereby said wire spring moves simultaneously with said follower along said rectangular cross-section passage in a manner that enables said free-end of said wire spring to project through said elliptical opening when said follower reaches its apogee and to retract beneath said rectangular upper surface when said follower is forced below its apogee by ammunition contained in said magazine.

2. An improved bolt catch actuator for a firearm ammunition magazine, said magazine comprising a proximal wall having an upper end defining the proximal side of a rectangular cross-section passage therein within which moves a U-shaped follower defined by a rectangular upper surface and right and left side plates depending therefrom, said bolt catch actuator comprising an elliptical opening through said upper end of said proximal wall extending into said rectangular cross-section passage of said firearm ammunition magazine and a wire spring defined by an upper free-end and a lower fixed-end, said wire spring being cantilevered by said lower fixed-end to said right side plate of said follower with said upper free-end positioned below said rectangular upper surface and biased proximally of said rectangular upper surface whereby said wire spring moves simultaneously with said follower along said rectangular cross-section passage in a manner that enables said free-end of said wire spring to project through said elliptical opening when said follower reaches its apogee and to retract beneath said rectangular upper surface when said follower is forced below its apogee by ammunition contained in said magazine.

* * * * *